United States Patent [19]

Brouse

[11] Patent Number: 4,577,554

[45] Date of Patent: Mar. 25, 1986

[54] KNOTTING APPARATUS FOR WIRE STRAPPING MACHINE

[75] Inventor: S. Bernard Brouse, Orland Park, Ill.

[73] Assignee: United States Steel Corporation, Pittsburgh, Pa.

[21] Appl. No.: 714,744

[22] Filed: Mar. 22, 1985

[51] Int. Cl.[4] ..... B30B 13/28

[52] U.S. Cl. ..... 100/26; 100/31; 140/93.6

[58] Field of Search ..... 100/26, 31; 140/93.6; 53/589

[56] References Cited

U.S. PATENT DOCUMENTS

| | | | |
|---|---|---|---|
| 2,812,707 | 11/1957 | Cheesman | 100/31 |
| 2,922,359 | 1/1960 | Brouse et al. | 100/26 |
| 2,982,199 | 5/1961 | Jones | 100/31 X |
| 3,037,534 | 6/1962 | Brouse | 140/93.6 |
| 3,060,841 | 10/1962 | Van De Bilt | 100/31 |
| 3,232,216 | 2/1966 | Cranston, Jr. et al. | 100/28 |
| 3,327,618 | 6/1967 | Cook | 100/4 |
| 3,889,584 | 6/1975 | Wiklund | 100/31 X |

*Primary Examiner*—Billy J. Wilhite

*Attorney, Agent, or Firm*—William F. Riesmeyer, III

[57] ABSTRACT

Apparatus for effecting the knotting of wire strapping applied to a package is provided. The knotting function is motivated by means of a hydraulic cylinder which displaces a rack gear which, in turn, drives a pinion gear to which a splined shaft is affixed. The shaft runs through the knotter unit housing which includes a twister pinion for knotting the wire, wire gripping means, cutting means, wire ejecting means and a wire cover means. In the operation of the apparatus disclosed, the end portion of the wire is fed by a remote feeder through a guide area, engaged by a gripping means and the wire is tensioned by the feeder. The hydraulic cylinder causes the shaft to rotate in a first direction which turns a first drive hub that engages a twister gear having a uni-directional pawl, which twister gear turns a twister pinion gear thereby twisting the wire. For cutting, the shaft rotates in a reverse direction and drives a cam by means of a pawl, said cam being engaged by a cam follower which is affixed to one end of a pivoting arm, the other end of such arm including a cutting blade. The wire is ejected from the knotting apparatus, also during rotation of the shaft in the reverse direction, by means of a uni-directional drive means which causes the "U"-shaped ejectors to be extended thereby opening the cover releasing the gripping means and driving the knotted wires from the unit. Following wire ejection, the ejectors are positively retracted and maintained in a ready position for removal of subsequent knots.

16 Claims, 7 Drawing Figures

KNOTTING APPARATUS FOR WIRE STRAPPING MACHINE

DESCRIPTION OF THE INVENTION

The present invention relates to wire strapping machines and, in particular, to an apparatus for forming a knot in a wire which has been looped about an article or articles to be secured by a strap.

In the field of materials handling, it is often advantageous to cause a securing strap to be placed about an object or to create a package by strapping together a plurality of objects. As used herein, "strap" or "strapping" applies to round or oval cross-section metallic wire which may be used to secure a package. Frequently such strapping is applied under tension to more firmly secure the bundle.

While differing methods may be utilized to secure such strapping, a most common procedure is to cause the wire to be twisted about itself in order that a knot is formed in the wire. Heretofore, various machines have attempted to accomplish the knotting of wire in different ways. However, one common element in virtually all prior knotting apparatuses was a twister pinion or slotted gear into which the wires to be joined were placed and the gear rotated, thereby twisting the wires. While such an element is commonly utilized, the remainder of the components of the knotting devices differed significantly.

It has become apparent that prior knotting apparatuses share certain problems which are alleviated in the herein-disclosed invention. For example, previous knotting apparatuses have proven to be overly mechanically complicated. Such complexity causes prior knotters to be more susceptible to breakdown as a large number of intricately moving parts are present. Also, the complexity of prior apparatuses causes significant problems in achieving the exacting timing necessary to accomplish the rapid knotting, cutting and ejection of the wire strapping without having the wire becoming jammed in the knotting unit or otherwise damaged and without having the rapid operations interfere with one another. The reduced complexity of the present invention as contrasted to other knotting devices yields benefits by providing a lower cost to manufacture, reduced maintenance, improved repeatability and improved reliability of high-quality knots.

In addition, the improved design of the herein-disclosed apparatus has provided a more compact wire knotting unit. Such compactness allows mounting of the present knotter in close quarters and in awkward configurations. As such, the present invention is suitable for applications heretofore impossible. Also, the design of the instant invention provides it the capability to function effectively on a wide variety of sizes of wire.

Accordingly, the subject invention is directed toward an improved apparatus for forming a knot in a wire strapping which overcomes, among others, the above-described problems and provides a knotting unit which is effective to form a knot in a variety of wire strappings yet is reliable and cost effective.

SUMMARY OF THE INVENTION

In accordance with the present invention, there is provided apparatus for forming a knot in a wire strapping material to secure an end portion of the wire to a body portion thereof and for cutting off the knot area from the remainder of the wire.

The knotting device provided may be positioned on the reciprocable pressing platen of a hydraulic compression apparatus which may be used to compress an object prior to the strapping thereof. Following the feeding of a wire strap about an object to be bound and the tensioning of the wire about the object, the herein disclosed apparatus is effective to form a securing knot in the wire.

The knotting apparatus includes a support housing having a twister pinion journaled in the central region thereof and a wire gripping means in the distal end of the housing to grasp the free end portion of the wire. A rack gear driven by a hydraulic cylinder is employed to rotate in a first and a reverse direction a pinion gear affixed to the end of a shaft which extends axially through the housing. Splined to the shaft is a first drive hub which drives a twister gear by means of a unidirectional clutch. As such, the first drive hub is rotatable only when the shaft is rotated by the rack gear in a first direction. An intermediate twister gear is in operative engagement between the first drive hub and the twister pinion to cause a twisting of the wires by the twister pinion while the ends of the wires are retained by the gripping means and fixed wire guide means. In addition, the spring loaded wire guide means provided are effective to accurately position the wires prior to twisting while still allowing twisting to occur without necessitating the additional preliminary steps of prior knotting units such as cover opening.

The end portion of the housing remote from the wire gripping means is provided with a second pawl driven, unidirectional drive hub to which is affixed a cam. The second drive hub, and hence the cam affixed thereto, are provided to be rotated only when the shaft is rotated in its reverse direction. The cam cooperates with a cam follower mounted on one end of a cutter bar to sever the wire to be tied from the wire supply source when the shaft is rotated in the reverse direction. Adjacent to and on either side of the first drive means are dual corresponding third drive hubs also splined to the common shaft. Ejector drive hubs having unidirectional clutches to permit rotation only when the shaft rotates in the reverse direction are provided around the third drive hubs. The ejector drive hubs are provided with rollers to engage cam surfaces on the "U"-shaped ejector units which drive the wire from the knotter unit. Such ejectors also serve to cause the cover which is pivoted to the housing to be retracted to allow knot removal from the housing. Finally, the retraction of the cover causes the release of the wire gripping means so as to allow the retained end portion of the wire to be released.

As such, the present invention provides solutions to the aforementioned problems present in the knotting of wire strapping material. Since this invention effectively forms a knot in a wire strapping and yet is mechanically less complicated and bulky, the problems present in the prior art are alleviated.

These and other details, objects and advantages of the invention will become apparent as the following description of the present preferred embodiment thereof proceeds.

BRIEF DESCRIPTION OF THE DRAWINGS

In the accompanying drawings, I have shown a present preferred embodiment of the invention wherein.

DETAILED DESCRIPTION OF THE INVENTION

Figure 1:
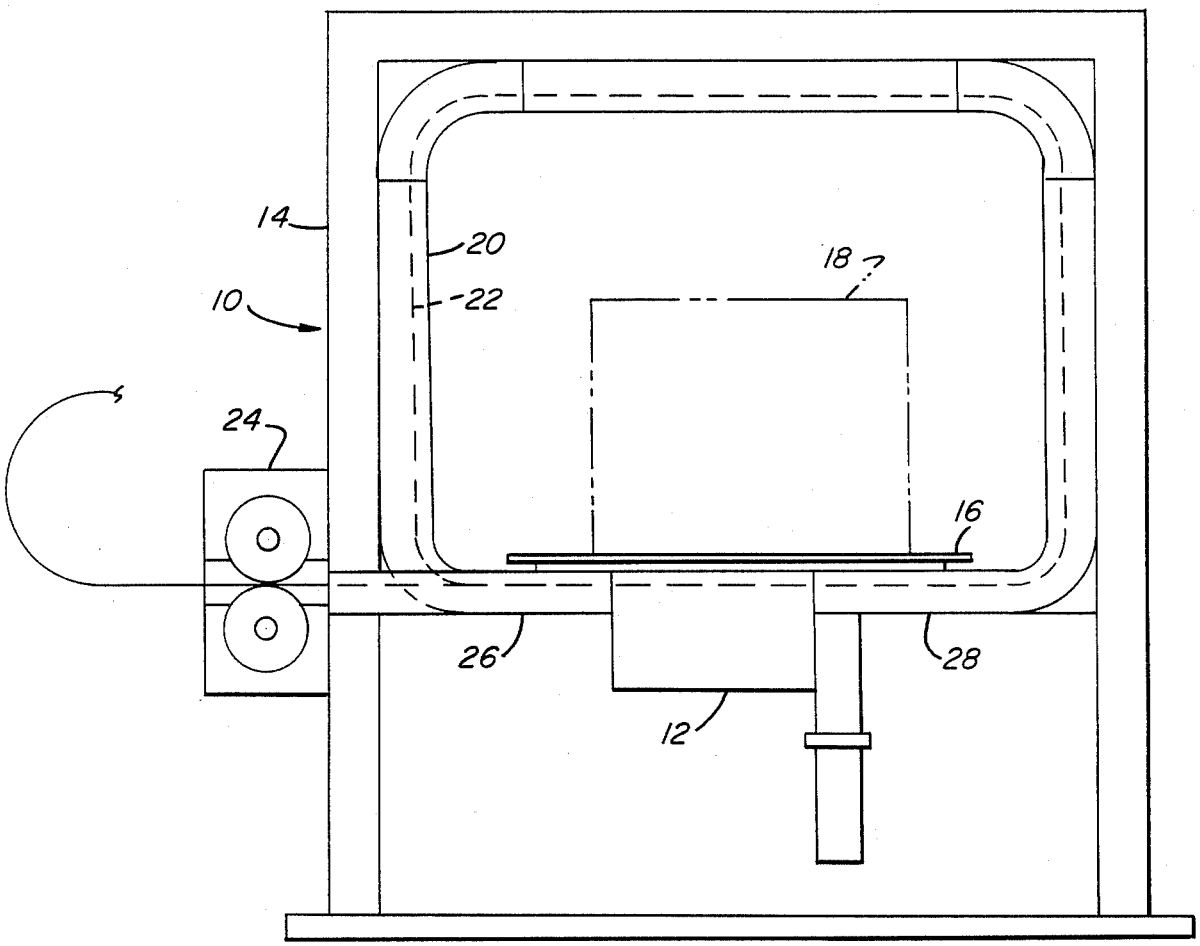
FIG. 1 is a front elevational view of the knotting device disclosed herein as installed on a complete wire strapping apparatus.

Referring now to the drawings wherein the showings are for purposes of illustrating the present preferred embodiment of the invention only and not for purposes of limiting same, the figures show an automatic wire strapping machine 10 provided with an apparatus 12 for forming a knot in a wire strapping material.

More particularly and with reference to FIG. 1, there is shown a gantry frame 14 having a table 16 disposed therewithin. Gantry frame 14 and table 16 define a strapping station for applying a wire strapping to a package 18. Gantry frame 14 supports a guide track 20 around which a wire 22 may be directed by means of wire feed and tension unit 24 so as to cause wire 22 to surround package 18. The knotter unit 12 is disposed beneath table 16 and preferably in the lower center region of gantry frame 14. Left and right guide blocks 26 and 28, respectively, are provided adjacent and on either side of knotter 12 so as to accurately guide the wire 22 during feeding therethrough and about guide track 20.

The overall operation of strapping apparatus 10 may be briefly summarized as follows. Wire 22 is fed from a source, not shown, through the remainder of strapping apparatus 10 by means of feed and tension unit 24. Unit 24 feeds wire 22 through left guide block 26, knotter unit 12, right guide block 28 and around guide track 20. The leading end portion 30 of wire 22 is then fed again through left guide block 26 and knotter 12 adjacent to and directly above the portion of wire 22 remaining in knotter 12. The wire end portion 30 is then stopped and retained by a wire gripping means, described in detail below, in the right side of knotter 12 as viewed in FIG. 1. The feeding of wire 22 by feed unit 24 is halted by means of a switch which is actuated by the gripper and the feed and tension motor is reversed to withdraw wire 22 from its course as described above so as to cause sufficient tension to be created in wire 22 to cause it to be stripped from guide track 20 and guide blocks 26 and 28 and bound tightly about package 18. At this point, the wire 22 completely surrounds package 18 except for the wire end portion 30 and that length of wire, hereinafter 32, still retained within knotter unit 12 and attached to the wire supply. As will be explained in greater detail below, knotter unit 12 then causes a twist knot to be formed between wires 30 and 32, cuts wire 32 and ejects the knot.

Figure 2:
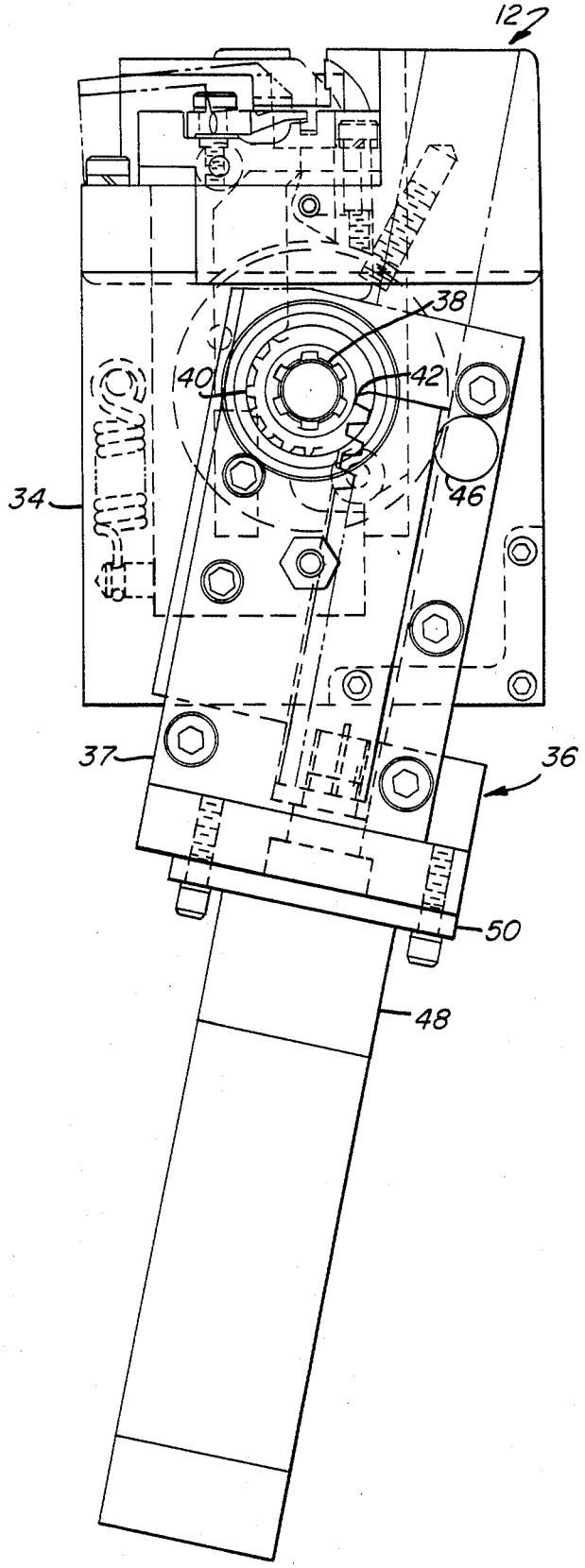
FIG. 2 is an end view of the present knotting apparatus showing the unit's drive mechanism.
Figure 6:
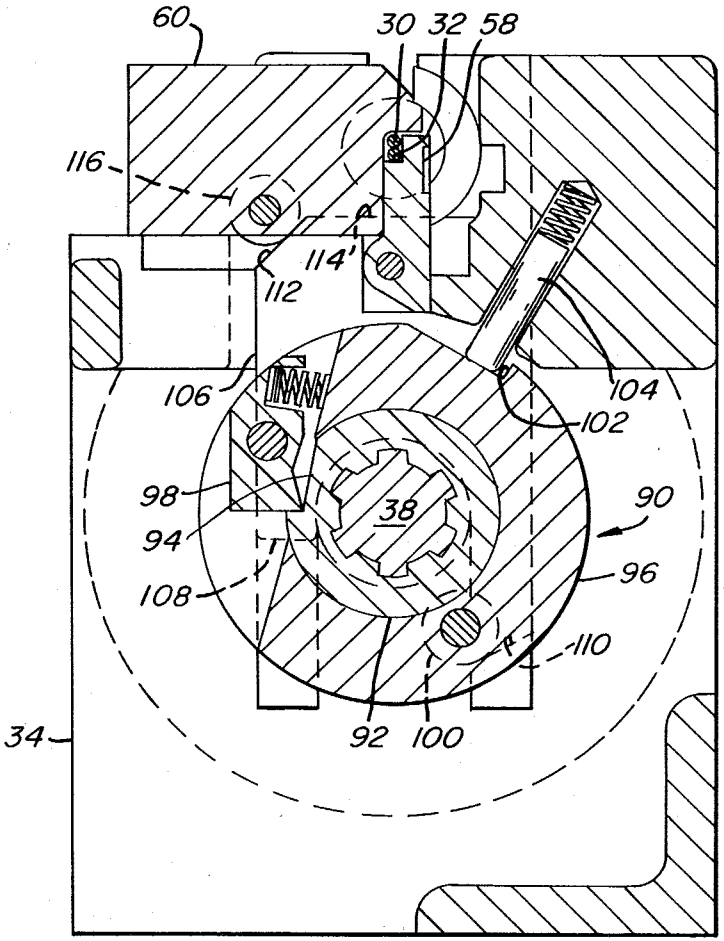
FIG. 6 is a cross-sectional view of the knotting apparatus taken along line 6—6 in FIG. 3; and, FIG. 7 is a plan view of the herein disclosed knotting apparatus.
Figure 4:
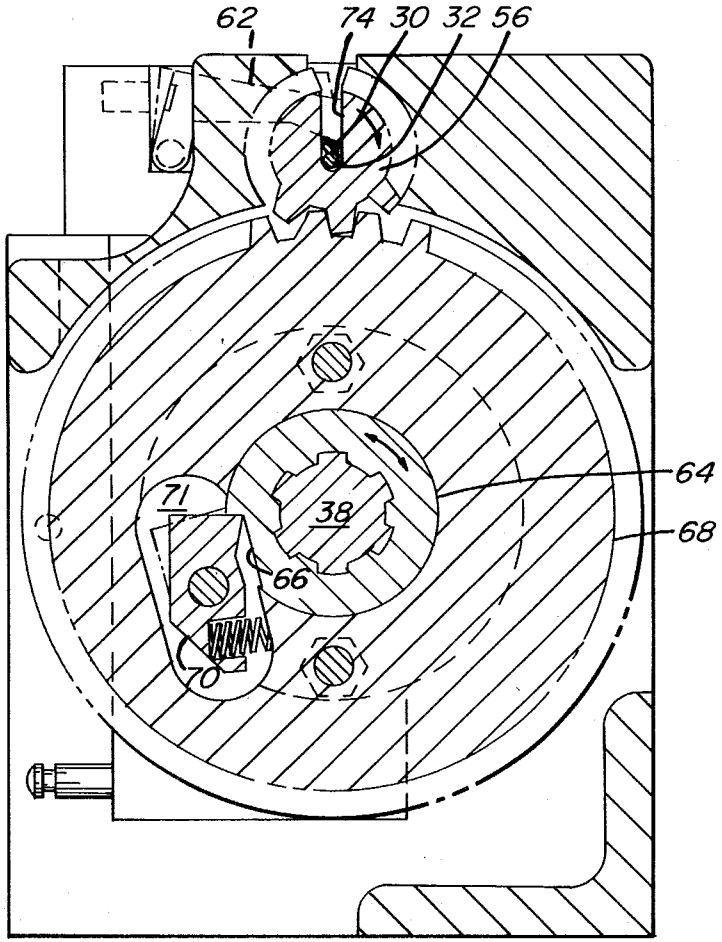
FIG. 4 is a cross-sectional view of the knotting apparatus taken along line 4—4 in FIG. 3.

Referring now to FIG. 2, there is shown the knotter unit 12 having housing 34 along with its drive mechanism, generally designated as 36. Drive unit 36 is provided with housing 37 (the cover of which is shown removed in FIG. 2) and is configured to drive an axial shaft 38 which extends throughout the length of housing 34 by means of drive pinion 40 splined to the end of shaft 38. Within housing 37 of drive unit 36 is disposed a rack gear 42 which is maintained in contact with drive pinion 40 by means of roller 46. The end of rack gear 42 remote from engagement with drive pinion 40 is connected to a reciprocable fluid motor 48, which may consist of a hydraulically driven piston supported by housing 37 by means of flange 50. Accordingly, it must be appreciated that when the piston of reciprocable cylinder 48 is extended, rack gear 42 is displaced in one direction which, in turn, causes drive pinion 40 and, hence, shaft 38 to be rotated in a first direction which is seen as counterclockwise as viewed in FIGS. 2, 4 and 6. Correspondingly, when the piston of cylinder 48 is retracted, the rack gear 42 is displaced in the opposite direction which rotates drive pinion 40 and, hence, shaft 38 in a reverse direction seen as clockwise in FIGS. 2, 4 and 6. It should be understood that drive mechanism 36 may, alternatively, and for purposes of example only, consist of a rotatable hydraulic or electric motor which is provided with a single revolution clutch enabling the rotation of shaft 38 in forward and reverse directions.

As was introduced above, shaft 38 extends axially throughout the length of housing 34 and journaled therein by means of bearings 52. Knotter unit 12 actually contains four regions in which work is performed. Knotter housing 34 includes a central region A wherein the knotting of wires 30 and 32 takes place and two adjacent regions B and C for, inter alia, ejecting the knotted wires. On the left side of knotter unit 12, region D, is provided a cutter to sever the portion of wire 32 which is attached to the wire supply.

Figure 3:
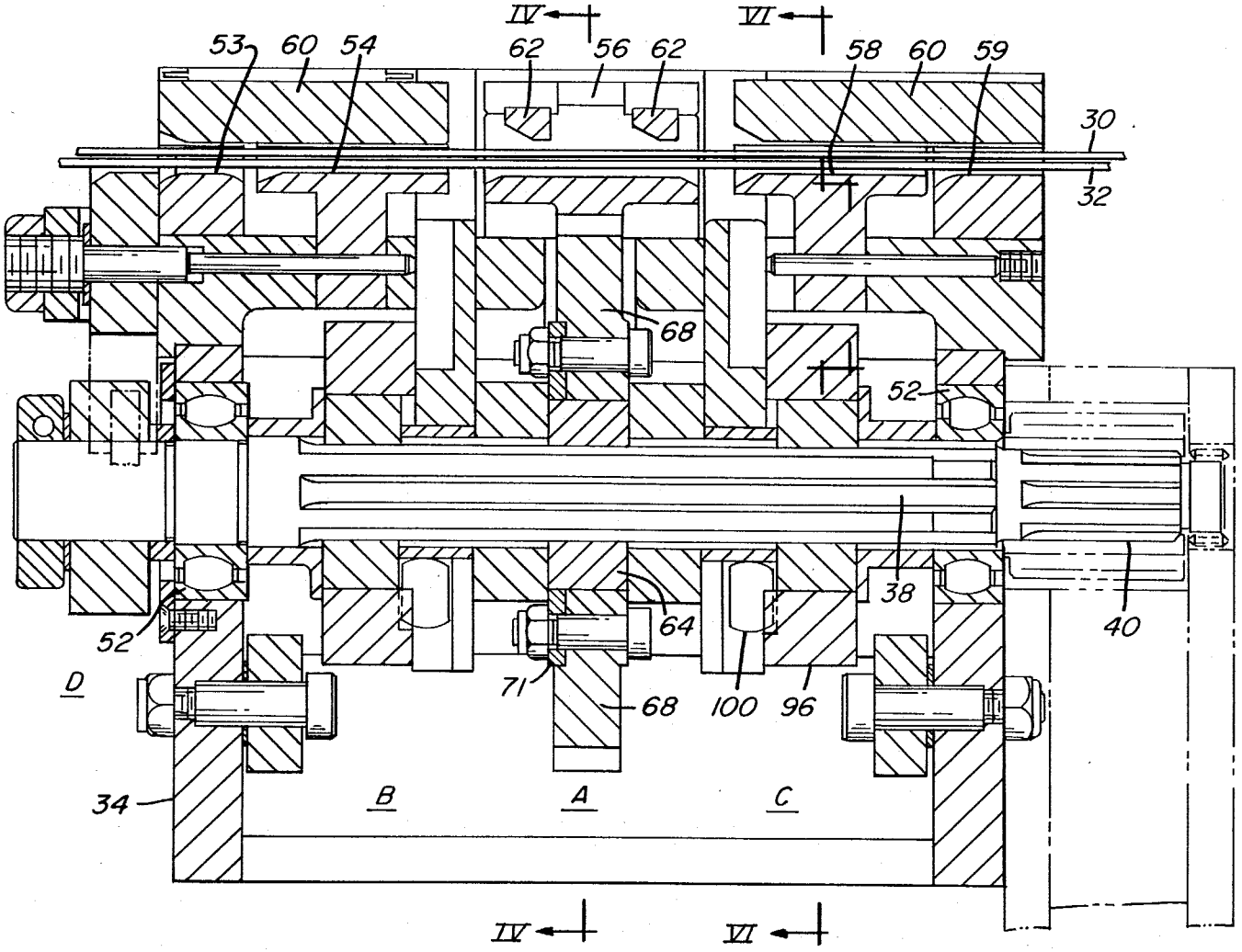
FIG. 3 is a front sectional view of the knotting apparatus.

As was described above, the end portion 30 of wire 22 is fed through knotter unit 12 from left to right as viewed in FIG. 3. Left wire yoke 53 and left wire guide 54 are provided in the upper left region of knotter housing 34 to receive wire end portion 30 as it is introduced into knotter 12. Wire end 30 then passes through twister pinion 56 which has a longitudinally extending and laterally opening slot in which both of the wires to be twisted are received in lapped generally parallel relation. The wire end 30 then passes through right wire guide member 58 and right wire yoke 59 and is retained by the gripping means 118, described below. Cover plate 60 is provided to retain wires 30 and 32 within left yoke 53, left and right wire guides 54 and 58, respectively, and right yoke 59. Wires 30 and 32 are retained within twister pinion 56 by means of spring biased horizontal finger 62. It is notable that the left yoke 53 and right yoke 59 in which wires 30 and 32 pass are configured so as to only allow the disposition of wire 30 above wire 32. Such a configuration holds the ends of wires 30 and 32 in place while the remainders of those wires are twisted. Left wire guide 54 and right wire guide 58 are configured to be pivotable within housing 34 and are spring-biased therein. As such, wire guides 54 and 58 are effective to completely constrain and guide the feeding of wire end portion 30 while being movable during the twisting of wires 30 and 32 to allow for the increased knot diameter created during twisting. This last mentioned feature is significant in that prior wire tying apparatuses necessitated an additional mechanical means of opening the wire cover member prior to knotting to accommodate the increased diameter produced by twisting.

In order to accomplish the knotting of wires 30 and 32 during the rotation of the shaft 38 in its first direction, there is provided in the central region of housing 34 a first drive hub 64 which is splined to shaft 38. Drive hub 64 is provided with a stepped region 66 on the outer peripheral surface thereof. Coaxial with and surrounding first drive hub 64 is twister gear 68 which meshes with twister pinion 56. A central cut-out area of twister gear 68 is provided to accommodate spring biased pawl 70 which is affixed to backing plate 71 which is in turn secured to the reverse side of twister gear 68. As such, when shaft 38 is rotated in a counterclockwise direction as viewed in FIG. 4, pawl 70 engages stepped region 66 on first drive hub 64 thereby causing the rotation of twister gear 68 therewith and the rotation of twister pinion 56 which twists wires 30 and 32 together while the ends thereof are retained by left yoke 53 and right yoke 59. Conversely, when shaft 38 is rotated in a clockwise direction as viewed in FIG. 4, the pawl 70 slips around the remainder of the periphery of first drive hub 64 and twister gear 68 and twister pinion 56 are not rotated. In order to assure the stationary position of twister pinion 56 during rotation of shaft 38 in the reverse direction, finger 62 also serves as an anti-back rotation dog to engage a flat surface 74 on the twister pinion 56 to prevent its rotation. Accordingly, as twister pinion 56 is prevented from reverse rotation so is twister gear 68, which causes pawl 70 to ride harmlessly on first drive hub 64.

Figure 5:
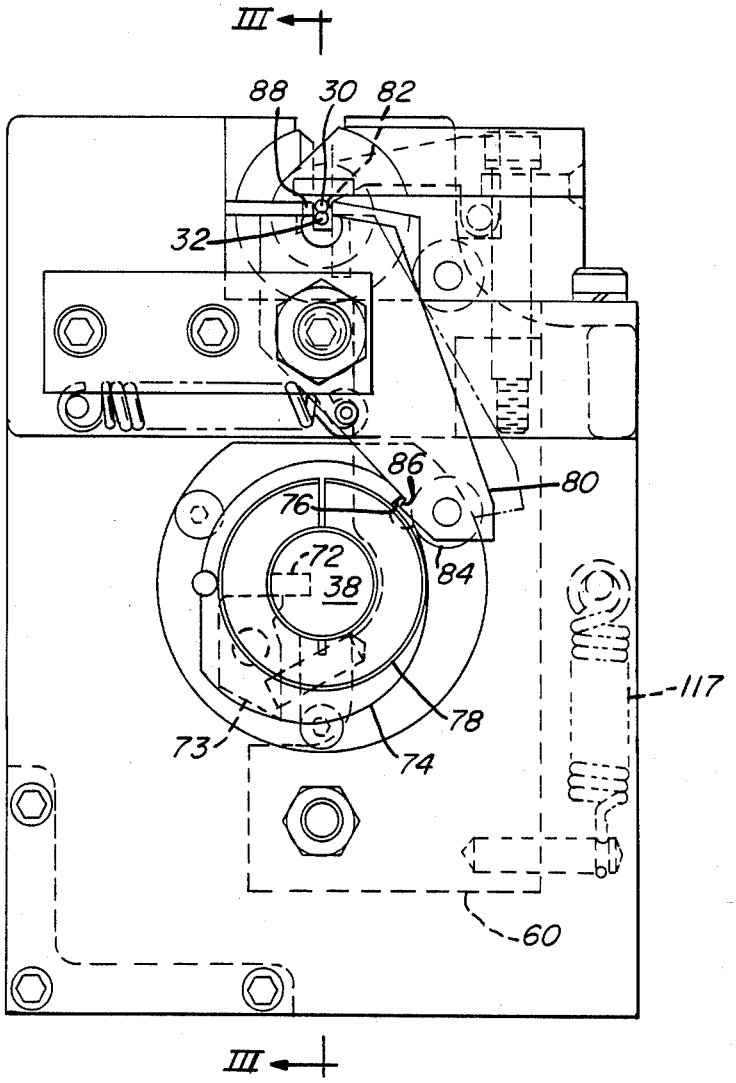
FIG. 5 is an end view of the opposite end of the knotting apparatus showing the cutting means included in the present invention.
Figure 7:
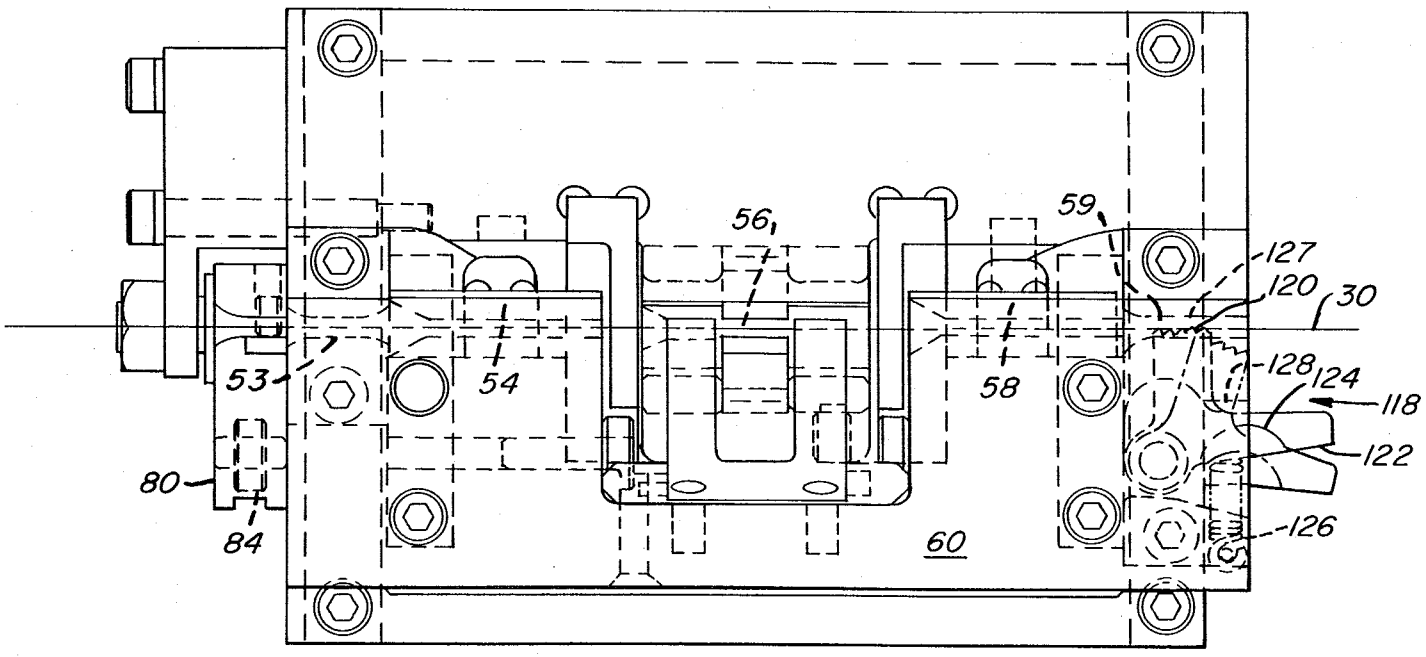

It will be apparent to one skilled in the art that in terms of mechanical efficiency and accurate repeatability it is preferable that all knotting occur during the forward stroke of the piston cylinder 48 and hence while rotation in the first direction of shaft 38, and the cutting and ejection of the knotted wires 30 and 32 be accomplished during the reverse stroke of cylinder 48 and the reverse rotation of shaft 38. As such, as soon as the piston of cylinder 48 begins its retraction stage thereby rotating shaft 38 in its reverse direction, the cutting function must be activated. The cutting of wire 32 which up to this point has remained connected to the wire supply occurs in the extreme left portion, region D of knotter 12, as viewed in FIGS. 3 and 7. The cutting function of knotter 12 is motivated by means of key 72 which fits into a notch on shaft 38 as viewed in FIG. 5. Spring-biased pawl 73 is mounted on a cutter cam 74 which is coaxial with and mounted on shaft 38. As such, when shaft 38 is moved in its reverse direction, key 72 engages pawl 73 which causes the movement in the reverse direction of cutter cam 74 which is coaxial with shaft 38. To prevent its movement when such is undesirable, cutter cam 74 is provided with a detent 76, the action of which is described below, on the opposite side thereof from the lobe of cutter cam 74. Protective collar 78 is affixed to the left end of shaft 38 outboard of cutter cam 74 to retain the same. Pivotally attached to the left portion of housing 34 is cutter lever 80 having a cutting surface 82 incorporated into the upper region thereof and a roller cam follower 84 journaled on its opposite end region. A detent 86 is formed ajacent roller 84 on cutter lever 80. In operation, roller cam follower 84 is configured to be in operative engagement with the cam surface of cutter cam 74. Accordingly, when shaft 38 is rotated in its reverse direction, which is seen as counterclockwise in FIG. 5, roller cam follower 84 rides along cutter cam 74 thereby pivoting cutter lever 80 about its pivot point and moving cutter surface 82 relative to a corresponding fixed cutter surface 88 which is affixed to housing 34. As such, wire 32 is cut by the movement of cutter surface 82 in cooperation with stationary surface 88. Any reverse rotation of cutter cam 74 is prevented by the engagement of its detent 76 with detent 86 on cutter lever 80.

Immediately following such cutting of wire 32 thereby serving to sever the knotted region of wire 22 consisting of wires 30 and 32 from the wire supply, such knotted region must be removed from knotter 12. Such removal is accomplished by ejector units, generally 90, which are provided in the outboard regions, B and C, of housing 34. As the operation of both ejector units 90 is identical, only the operation of right ejector unit 90, as viewed in FIG. 3, will be described in detail. The action of ejector unit 90 is also motivated by shaft 38 during its reverse rotation by means of an ejector drive hub 92 which is also splined to shaft 38 and includes a stepped region 94 on the peripheral surface thereof. Coaxial with and surrounding ejector drive hub 92 is hub 96 which includes a cut-out peripheral area to accommodate a spring-biased ejector pawl 98 which is affixed thereto. As such, when shaft 38 is rotated in its reverse direction, which is clockwise as viewed in FIG. 6, ejector drive hub 92 is similarly rotated which causes step 94 to engage pawl 98 in order to cause hub 96 to rotate in the reverse direction.

Rotatably attached to the face of drive hub 96 is roller 100. In addition, the outer peripheral surface of hub 96 includes an additional stepped area 102. Spring-biased pin 104 is provided in housing 34 to cooperate with step 102 in the outer periphery of hub 96 to prevent the rotation thereof when shaft 38 is rotated in its first direction. Immediately adjacent to drive hub 96 is a generally "U"-shaped ejector member 106 having a first cam surface 108 disposed on one leg thereof and a second cam surface 110 disposed on the other leg. In addition, a beveled region 112 is provided adjacent the upper flat surface 114 of ejector member 106. As was mentioned above, pivotally affixed to the upper portion of housing 34 is cover member 60. Cover 60 is provided with a roller 116 journaled in the lower portion of the top region thereof. In addition, cover member 60 is normally biased closed by means of springs 117.

As was stated above, the present knotter unit 12 is provided with a pivotable wire gripping means 118. The gripper 118 consists of a two-armed lever pivoted at its central point on housing 34. One arm of gripper 118 includes a gripping surface 120 in facing relation to wire 30 (shown schematically in FIG. 7) and the other arm 122 includes a cam surface 124. Spring 126 is provided to normally bias gripping surface 120 toward surface 127 on right yoke 59.

Accordingly, the entire process of ejecting the knotted wires 30 and 32 is described as follows. When shaft 38 begins its reverse rotation, ejector drive hub 92 is rotated clockwise as viewed in FIG. 6 which causes the engagement of pawl 98 with stepped surface 94 thereby causing the clockwise rotation of hub 96 and the movement of roller 100 about the axis of shaft 38. However, in order to allow a sufficient passage of time to accomplish the cutting of wire 32, roller 100 does not engage cam 108 for a period of dwell. When roller 100 reaches first ejector cam 108, it causes ejector member 106 to be lifted. Such lifting causes cover roller 116 to ride up on beveled surface 112 thereby causing cover 60 to be pivoted and opened against the action of its biasing springs 117. Simultaneously, a projection 128 on the underside of cover 60 engages cam surface 124 on gripper 118 thereby releasing gripping surface 120 from engagement with wire end 30. Following the opening of cover 60, the flat surface 114 of ejector member 106 reaches the knot formed between wires 30 and 32 and forces such knot clear of knotter unit 12. As ejector drive hub 92 continues to rotate in the reverse direction, roller 100 engages and rides on second cam surface 110 which causes ejector member 106 to be positively driven downward into its retracted position. Cover 60 is then closed by means of cover biasing springs 117. At this point, the knotter unit 12 is ready to apply the next knot as pin 104 retains hub 96 in a stationary position during rotation of shaft 38 in its first direction. During rotation in the first direction, roller 100 is preferably maintained in contact with cam surface 110 thereby assuring the continuing retraction of ejector member 106 during twisting.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A knotter mechanism for a wire-tying machine comprising:

a. a support housing having means defining a wire path therethrough;

b. an axial shaft journaled in said housing;

c. means to rotate said shaft in a first direction and in a reverse direction;

d. first drive means releasably connected to said shaft so as to be rotatable with said shaft only when said shaft rotates in said first direction;

e. a twister pinion journaled in said housing along said wire path and in operative engagement with said first drive means;

f. second drive means releasably connected to said shaft so as to be rotatable with said shaft only when said shaft rotates in said reverse direction;

g. a cutter bar pivotally attached to said housing and in operative engagement with said second drive means, said cutter bar being pivotable by being engaged by said second drive means when said second drive means is rotated by said shaft when said shaft is rotated in said reverse direction;

h. third drive means releasably connected to said shaft so as to be rotatable with said shaft only when said shaft rotates in said reverse direction; and, i. wire ejector means slidably mounted in said housing and adjacent said twister pinion, said ejector means being reciprocable between a retracted position and an extended position by said third drive means when said third drive means is rotated by said shaft when said shaft is rotated in said reverse direction.

2. Apparatus of claim 1 further comprising:

a. a wire cover member movably mounted on said housing adjacent said wire path and adjacent said ejector means, said cover being movable between a first position adjacent said wire path and a retracted position remote from said wire path; and, b. means for moving said wire cover member between said first and said retracted positions.

3. Apparatus of claim 2 further comprising wire gripping means adjacent to said wire path and pivotally attached to said housing, said gripping means being effective to grip the end portion of said wire and to retain same, said gripping means being pivotable by being engaged by said cover member so as to release the end portion of said wire when said cover member is moved from its first position to its retracted position.

4. Apparatus of claim 3 in which said means to rotate said shaft comprises:

a. a base plate affixed to said housing;

b. a hydraulic cylinder affixed to said base plate, said hydraulic cylinder having a reciprocable piston;

c. a rack gear affixed to said reciprocable piston of said hydraulic cylinder; and, d. a pinion gear affixed to said shaft, said pinion gear being in operative engagement with said rack gear so as to move said shaft in said first and said reverse directions in response to the movement of said rack gear.

5. Apparatus of claim 4 in which said first drive means comprises:

a. a first drive hub affixed to said shaft;

b. a twister gear coaxial with and disposed about said drive hub; and, c. a first unidirectional clutch disposed intermediate and in operative engagement with said twister gear and said first drive hub, said first unidirectional clutch being effective so as to permit the rotation of said twister gear only when said shaft rotates in said first direction.

6. Apparatus of claim 5 in which said first unidirectional clutch comprises:

a. a recessed area on the circumferential surface of said first drive hub; and, b. a spring-biased pawl affixed to said twister gear so as to engage with said recessed area only when said shaft is rotated in said first direction.

7. Apparatus of claim 6 further comprising:

a. a first cutting surface affixed to one end of said cutter bar; and b. a fixed cutting surface affixed to said housing.

8. Apparatus of claim 7 in which said second drive means comprises:

a. a second drive hub affixed to said shaft;

b. a cutter drive hub coaxial with and disposed about said second drive hub, said cutter drive hub having a cam surface on its peripheral surface; and, c. a second unidirectional clutch operatively disposed intermediate and in operative engagement with said second drive hub and said cutter drive hub so as to permit the rotation of said cutter drive hub only when said second drive hub is rotated in said reverse direction.

9. Apparatus of claim 8 further comprising:

a. spring biasing means attached to said cutter lever so as to normally urge said first cutting surface away from said fixed cutting surface; and, b. a roller rotatably supported on the opposite end of said cutter bar from said first cutting surface and adjacent said cam surface of said cutter drive hub, said roller being effective to ride on said cam surface and to move said first cutting surface toward said fixed cutting surface when said cutter drive hub is rotated.

10. Apparatus of claim 9 in which said wire ejector means comprises a "U"-shaped member having a wire pushing surface on the body portion thereof, a first cam surface on a first leg thereof and a second cam surface on a second leg thereof.

11. Apparatus of claim 10 in which said third drive means comprises:

a. a third drive hub affixed to said shaft;

b. an ejector drive hub coaxial with and disposed about said third drive hub;

c. a unidirectional clutch disposed intermediate and in operative engagement with said third drive hub and said ejector drive hub so as to permit rotation of said ejector drive hub only when said third drive hub is rotated in said reverse direction; and, d. a roller rotatably attached to said ejector drive hub, said roller being effective to engage said first cam surface of said ejector member so as to drive said ejector means from its retracted position to its extended position, said roller being also effective to engage said second cam surface of said ejector member so as to drive said ejector means from its extended position to its retracted position.

12. Apparatus of claim 11 in which said cover member is biased so as to be normally disposed in said first position and said cover member is movable from said first position to said retracted position by being engaged by said ejector means when said ejector means is reciprocated from its retracted position to its extended position.

13. Apparatus of claim 11 in which said means defining a wire path through said housing comprises:

a. fixed wire yokes disposed at each end of said housing; and, b. movable wire guides disposed within said housing inboard of said wire yokes, said wire guides being spring biased so as to allow sufficient displacement thereof away from said wire path to allow the twisting of wires about one another.

14. Apparatus of claim 13 further comprising a pivotable, biased twister finger adjacent said twister pinion and configured to cooperate with said twister pinion so as to retain said wires therein during wire feeding and to selectively engage said twister pinion so as to prevent the rotation of said twister pinion when said shaft is rotated in said reverse direction.

15. The knotting apparatus of claim 1 in combination with a wire strapping machine comprising:

a. an upstanding guide track adapted to receive and hold a loop of wire placed therearound, b. means for placing said wire around said track to form a wire loop; and, c. means for removing said wire loop from said guide track and tightening said wire loop about a package to be bound.

16. The apparatus of claim 14 in combination with a wire strapping machine comprising:

a. an upstanding guide track adapted to receive and hold a loop of wire placed therearound;

b. means for placing said wire around said track to form a wire loop; and, c. means for removing said wire loop from said guide track and tightening said wire loop about a package to be bound.

* * * * *